US011808142B2

(12) United States Patent
Gauthier et al.

(10) Patent No.: US 11,808,142 B2
(45) Date of Patent: Nov. 7, 2023

(54) HYDROCARBON WELLS INCLUDING TRACER SYSTEMS AND METHODS OF TRACING A FLOW PATH OF LIFT GAS WITHIN A HYDROCARBON WELL UTILIZING A RADIOACTIVE TRACER

(71) Applicant: ExxonMobil Technology and Engineering Company, Spring, TX (US)

(72) Inventors: Gaston L Gauthier, Houston, TX (US); Tony W. Hord, Spring, TX (US); Michael C. Romer, The Woodlands, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 0 days.

(21) Appl. No.: 17/810,662

(22) Filed: Jul. 5, 2022

(65) Prior Publication Data

US 2023/0012126 A1 Jan. 12, 2023

Related U.S. Application Data

(60) Provisional application No. 63/219,387, filed on Jul. 8, 2021.

(51) Int. Cl.
*E21B 47/11* (2012.01)
*E21B 43/12* (2006.01)

(52) U.S. Cl.
CPC ..... *E21B 47/111* (2020.05); *E21B 43/123* (2013.01)

(58) Field of Classification Search
CPC .. E21B 43/123; E21B 43/122; E21B 43/1235; E21B 43/13; E21B 47/11; E21B 47/111
See application file for complete search history.

(56) References Cited

U.S. PATENT DOCUMENTS 4,972,704 A * 11/1990 Wellington ..... E21B 43/122 73/19.1
5,410,152 A * 4/1995 Gadeken ..... G01V 5/04 250/260
2017/0107811 A1* 4/2017 Romer ..... E21B 43/123

* cited by examiner

*Primary Examiner* — Kristyn A Hall
(74) *Attorney, Agent, or Firm* — ExxonMobil Technology and Engineering Company—Law Department

(57) ABSTRACT

The hydrocarbon wells include a radioactive tracer system, a production conduit, a lift gas supply conduit, a lift gas supply system configured to provide a lift gas stream to the lift gas supply conduit, and one or more gas lift valves each being configured to selectively permit lift gas to enter the production conduit and mix with reservoir liquid therein to generate a produced fluid stream. The radioactive tracer system is configured to inject a radioactive tracer into the lift gas stream and to detect the radioactive tracer within the produced fluid stream. The methods include injecting the radioactive tracer into the lift gas stream, flowing the radioactive tracer through an open gas lift valve into the production conduit, mixing the radioactive tracer with the reservoir liquid to generate a tracer-marked liquid band within the produced fluid stream, and detecting radiation from the tracer-marked liquid band.

19 Claims, 2 Drawing Sheets

HYDROCARBON WELLS INCLUDING TRACER SYSTEMS AND METHODS OF TRACING A FLOW PATH OF LIFT GAS WITHIN A HYDROCARBON WELL UTILIZING A RADIOACTIVE TRACER

CROSS-REFERENCE TO RELATED APPLICATIONS

This application claims the benefit of U.S. Provisional Application Ser. No. 63/219,387, filed Jul. 8, 2021, the disclosure of which is hereby incorporated by reference in its entirety.

FIELD OF THE INVENTION

The present disclosure relates to hydrocarbon wells having radioactive tracer systems and methods of tracing a flow path of lift gas within a hydrocarbon well utilizing radioactive tracers.

BACKGROUND OF THE INVENTION

Some hydrocarbon wells do not have enough reservoir pressure to transport reservoir fluids from a subterranean region to a surface region and/or to transport the reservoir fluids at an economically viable flow rate. In such hydrocarbon wells, artificial lift may be utilized to facilitate and/or increase production of the reservoir fluids from the hydrocarbon wells. Various artificial lift methodologies exist, including hydraulic pumping systems, electric submersible pumps, rod pumps, and/or gas lift, and each of these methodologies may be particularly well-suited for certain corresponding hydrocarbon well configurations.

Gas lift methodologies generally utilize a series of gas lift valves spaced-apart along a length of the hydrocarbon well. These gas lift valves are configured to inject a high-pressure gas stream into production tubing of the hydrocarbon well. The high-pressure gas stream decreases an average density of fluids produced by the hydrocarbon well and facilitates production of reservoir fluids from the hydrocarbon well.

The productivity and efficiency of gas lift operations within a given well may depend upon a variety of factors, including the number of active gas lift valves that are supplying lift gas to the production tubing at a given time and/or the depth of the active gas lift valves relative to a desired injection point. Such wells often will produce fluids even if they are not optimally configured. Thus, being able to identify which gas lift valve(s) are actively supplying lift gas within a well is important to optimizing performance of the gas lift operation.

$CO_2$ injection has been utilized to identify the flow path of lift gas within a gas lift operation. Generally speaking, $CO_2$ injection methods include injecting a slug of $CO_2$ into the lift gas stream and using gas chromatography (GC) to detect the $CO_2$ when it returns in the produced fluids. $CO_2$ tracing, however, generally is an intensive process that is costly and not suitable for many well sites. In particular, the produced fluids must be sampled directly to detect $CO_2$ with GC. This means that pressure containment may be broken for $CO_2$ detection, which adds risk to the process. In addition, liquids present within the produced fluids may interfere with the GC. Furthermore, $CO_2$ tracing requires bulky equipment for supplying the $CO_2$ at pressure, which is logistically difficult in remote areas. Thus, a need exists for improved systems and methods for tracing lift gas within hydrocarbon wells.

SUMMARY OF THE INVENTION

Hydrocarbon wells and methods of tracing lift gas within hydrocarbon wells are disclosed herein. The hydrocarbon wells include a wellbore extending within a subsurface region and a tubular extending within the wellbore. The tubular defines a tubular conduit, and the wellbore and the tubular define an annular space therebetween. The hydrocarbon wells also include a lift gas supply system configured to provide a lift gas stream that includes a lift gas to a lift gas supply conduit that is defined by one of the annular space and the tubular conduit. The other of the tubular conduit and the annular space defines a production conduit configured to produce a produced fluid stream, which includes a reservoir fluid, from the subsurface region. The hydrocarbon wells further include one or more gas lift valves operatively attached to the tubular within the subsurface region. Each gas lift valve is configured to selectively open to permit lift gas to flow into the production conduit from the lift gas supply conduit and to mix with the reservoir liquid therein to generate the produced fluid stream. The hydrocarbon wells yet further include a radioactive tracer system configured to indicate a flow path of lift gas within the hydrocarbon wells. The radioactive tracer injection system includes a radioactive tracer injection unit and a radiation detector. The radioactive tracer injection unit is configured to inject a radioactive tracer into the lift gas stream to produce a tracer-marked gas band within the lift gas stream. The radiation detector is configured to detect the radioactive tracer within the produced fluid stream.

The methods include injecting a radioactive tracer into the lift gas stream to generate a tracer-marked gas band within the lift gas stream, flowing the tracer-marked lift gas band into a subterranean formation via the lift gas supply conduit, and flowing at least a portion of the tracer-marked lift gas band through an open gas lift valve into the production conduit. The flowing also includes mixing at least the portion of the tracer-marked gas band with the reservoir fluid, within the production conduit, to generate a tracer-marked liquid band within the produced fluid stream. The methods further include producing the produced fluid stream from the hydrocarbon well via the production conduit and detecting radiation from the tracer-marked liquid band of the produced fluid stream.

DETAILED DESCRIPTION OF THE INVENTION

Figure 1:
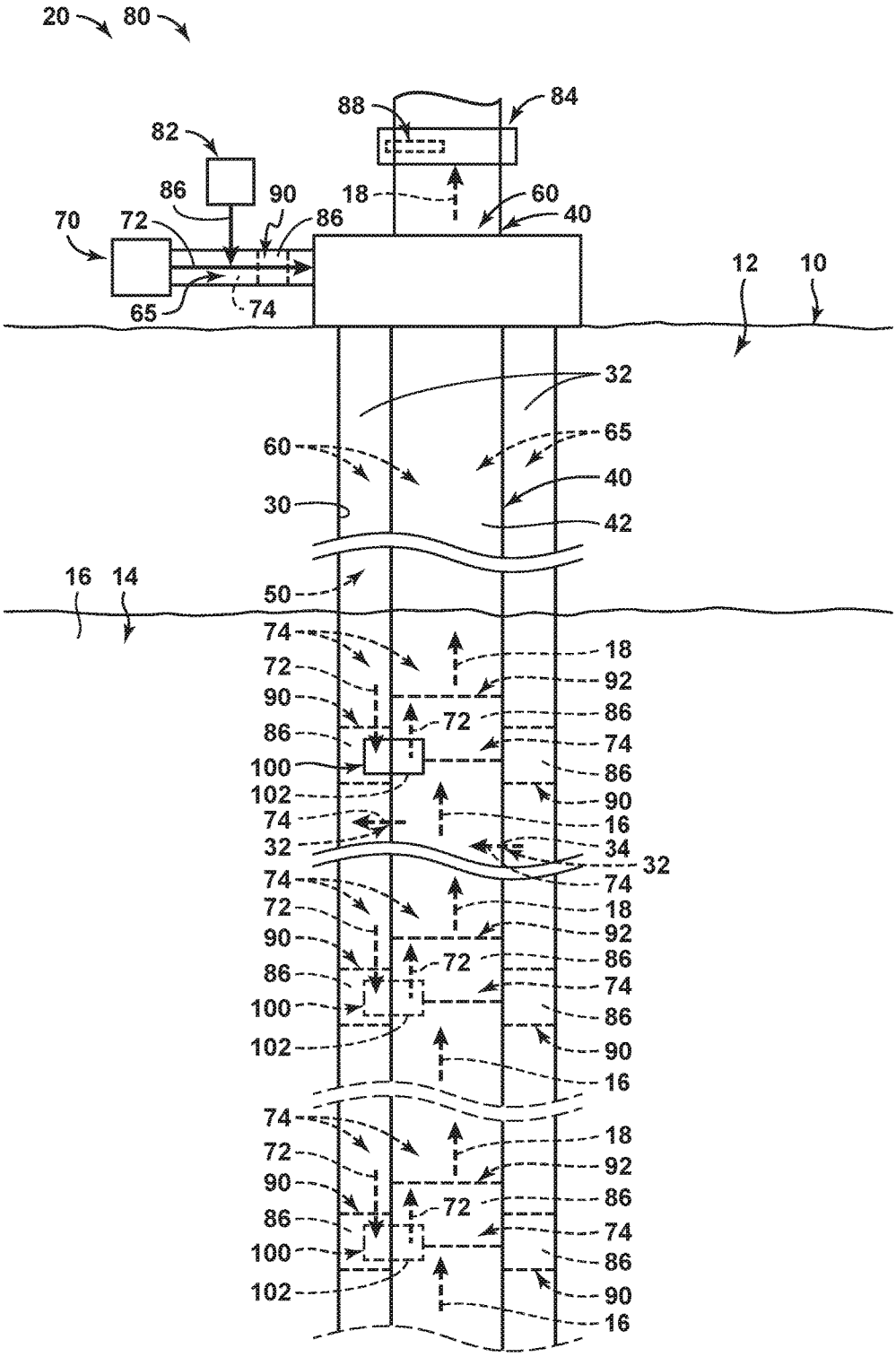
FIG. 1 is a schematic representation showing examples of hydrocarbon wells having radioactive tracer systems according to the present disclosure.
Figure 2:
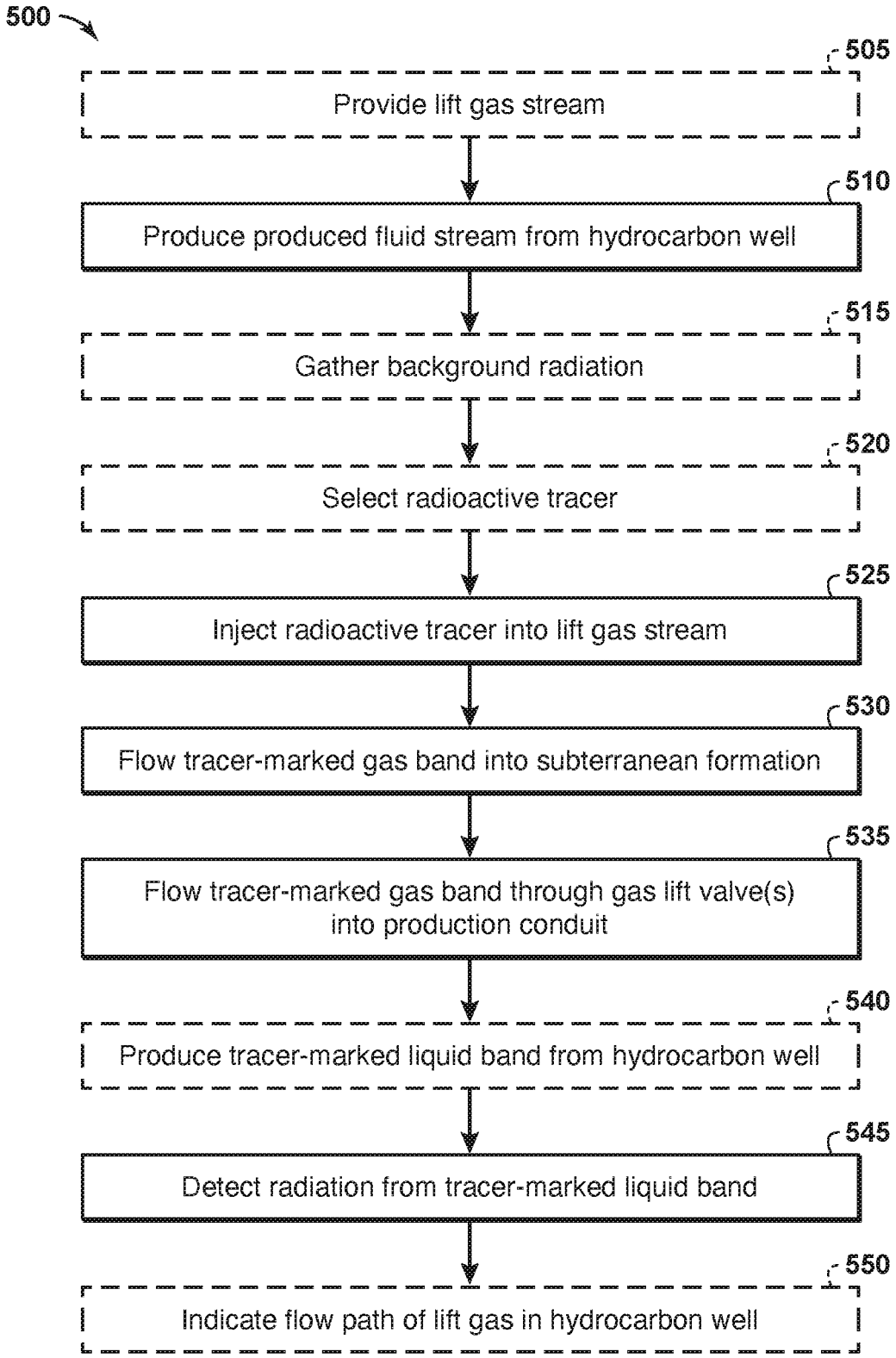
FIG. 2 is a flowchart schematically representing examples of methods of tracing a flow path of lift gas within a hydrocarbon well according to the present disclosure.

FIGS. 1-2 provide examples of hydrocarbon wells 20 including radioactive tracer systems 80 and methods 500 of tracing a flow path of lift gas within a hydrocarbon well utilizing a radioactive tracer. Elements that serve a similar, or at least substantially similar, purpose are labeled with like numbers in each of FIGS. 1-2, and these elements may not be discussed in detail herein with reference to each of FIGS. 1-2. Similarly, all elements may not be labeled in each of FIGS. 1-2, but reference numerals associated therewith may be utilized herein for consistency. Elements, components, and/or features that are discussed herein with reference to one or more of FIGS. 1-2 may be included in and/or utilized with any of FIGS. 1-2 without departing from the scope of the present disclosure.

In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic representation showing examples of hydrocarbon wells 20 according to the present disclosure. Hydrocarbon wells 20 include a wellbore 30 that extends within a subsurface region 12. Wellbore 30 also may be referred to herein as extending within a subterranean formation 14, which may include a reservoir liquid 16. Reservoir liquid 16 may include or be hydrocarbon fluids. Additionally or alternatively, wellbore 30 may be referred to as extending between a surface region 10 and the subterranean formation 14. Reservoir liquid 16 additionally or alternatively may be referred to as reservoir fluid 16.

Hydrocarbon well 20 also includes a tubular 40 that extends within wellbore 30. Tubular 40 forms, defines, and/or at least partially bounds a tubular conduit 42. Tubular 40 and wellbore 30 define an annular space 50 therebetween. Tubular 40 additionally or alternatively may be referred to herein as downhole tubular 40, tubing 40, and/or downhole tubing 40.

Hydrocarbon well 20 further includes a lift gas supply system 70 that is configured to provide a lift gas stream 72 that includes lift gas 74 to a lift gas supply conduit 65. In particular, one of annular space 50 and tubular conduit 42 may be referred to herein as, may function as, and/or may be a production conduit 60 of the hydrocarbon well, while the other of annular space 50 and tubular conduit 42 may be referred to as, may function as, and/or may be lift gas supply conduit 65. Production conduit 60 may be configured and/or utilized to guide, channel, and/or provide, from subsurface region 12 to surface region 10, a produced fluid stream 18 that includes reservoir liquid 16. Lift gas supply conduit 65 may be configured and/or utilized to guide, channel, and/or provide lift gas stream 72 from surface region 10 to subsurface region 12.

For purposes of illustration, lift gas supply system 70 is illustrated in FIG. 1 as providing lift gas stream 72 to annular space 50, such that annular space 50 defines lift gas supply conduit 65 and such that tubular conduit 42 defines production conduit 60. However, hydrocarbon wells 20, according to the present disclosure, additionally or alternatively may be configured such that annular space 50 is configured and/or utilized as production conduit 60 and tubular conduit 42 is configured and/or utilized as lift gas supply conduit 65. In such examples, lift gas supply system 70 may be configured to provide lift gas stream 72 to tubular conduit 42. Additionally or alternatively, hydrocarbon well 20 may be configured such that the production conduit 60 is selectively varied between tubular conduit 42 and the annular space 50. Under these conditions, the lift gas supply conduit will selectively vary between the tubular conduit and the annular space in a corresponding manner. Stated another way, at any given point in time, the production conduit is defined by one of the tubular conduit and the annular space, while the lift gas supply conduit is defined by the other of the tubular conduit and the annular space.

Lift gas supply system 70 may include any suitable structure that may be adapted, configured, designed, and/or constructed to provide lift gas stream 72 to lift gas supply conduit 65. As examples, lift gas supply system 70 may include one or more fluid conduits, pipes, tubes, valves, compressors, lift gas storage tanks, lift gas generators, and/or the like. Examples of the lift gas stream include an air stream, a natural gas stream, a carbon dioxide stream, and/or a nitrogen stream.

Hydrocarbon wells 20 include at least one gas lift valve operatively attached to tubular 40 within the subsurface region. Hydrocarbon wells may include a plurality of gas lift valves 100 operatively attached to tubular 40 and spaced apart along a length of tubular 40. Each gas lift valve 100 is configured to selectively open to permit the lift gas, within lift gas stream 72, to flow into production conduit 60 from lift gas supply conduit 65 and to mix with reservoir liquid 16 therein to generate produced fluid stream 18. With this in mind, produced fluid stream 18 may include a mixture that includes lift gas 74, or a subset of lift gas stream 72, and reservoir liquid 16. Produced fluid stream 18 may include an average density that is less than an average density of reservoir liquid 16 due to the presence of lift gas 74 in produced fluid stream 18. Due to the lower density of produced fluid stream 18, produced fluid stream 18 may flow towards, or to, surface region 10 under hydrostatic pressures within hydrocarbon well 20 that are insufficient to cause reservoir liquid 16 to flow towards surface region 10, and/or that are insufficient to cause reservoir liquid 16 to flow towards surface region 10 at the same rate, or as high a rate, as produced fluid stream 18.

Each gas lift valve 100 also may be configured to close to restrict flow of lift gas 74 from lift gas supply conduit 65 to production conduit 60. As discussed herein, a gas lift valve 100 that is open to permit lift gas 74 to flow into production conduit 60 from lift gas supply conduit 65 may be referred to herein as an open gas lift valve 102.

During operation of hydrocarbon well 20, lift gas supply system 70 may provide lift gas stream 72 to lift gas supply conduit 65. The lift gas stream may pressurize lift gas supply conduit 65, thereby generating, or increasing, a pressure differential between lift gas supply conduit 65 and production conduit 60. The pressure differential may vary along the length of wellbore 30 with depth due to hydrostatic pressure effects. As such, the pressure differential across each gas lift valve 100 may differ from the pressure differential across each other gas lift valve 100.

The gas lift valve(s) 100 may be configured such that lift gas stream 72 is injected or provided to production conduit 60 at one or more desired locations along the length of wellbore 30. Thus, during operation of hydrocarbon well 20, at least one gas lift valve 100, and optionally a plurality of gas lift valves 100, may be open to provide lift gas stream 72 to production conduit 60, while the other gas lift valves 100, if any, may be closed and not providing lift gas stream 72 to production conduit 60. In other words, during operation of hydrocarbon well 20, a subset of the plurality of gas lift valves 100, which may include fewer than all of gas lift valves 100, may be open gas lift valves 102.

With this in mind, each gas lift valve 100 may be selectively actuated to open or close based upon one or more conditions, stimuli and/or mechanisms. As examples, one or more gas lift valves 100 may be mechanically actuated, in which gas lift valve 100 may be biased closed and may open when the pressure differential thereacross exceeds a selected threshold pressure and/or is within a selected threshold pressure range. As another example, one or more gas lift valves 100 may be electrically actuated, in which case gas lift valve 100 may selectively open or close responsive to receipt of electrical stimulus, which may be provided from surface region 10 or an onboard regulator. As yet another example, one or more gas lift valves 100 may be chemically actuated. A chemically actuated gas lift valve 100 may be configured to open or close responsive to contact with one or more selected chemicals in reservoir liquid 16 or one or more selected chemicals that are introduced to lift gas stream 72. Regardless of the exact configuration, gas lift valves 100 may not, necessarily, open and/or close under desired, prescribed, and/or preselected conditions, and the hydrocarbon wells and methods, disclosed herein, may be utilized to verify their operation.

More specific examples of suitable gas lift valves that may be included in hydrocarbon well 10 include injection pressure operated gas lift valves, production pressure operated gas lift valves, orifice gas lift valves, pilot gas lift valves, as well as other types of gas lift valves known in the art.

The location, or locations, along the length of wellbore 30 at which lift gas stream 72 is injected into production conduit 60 may be determined by which gas lift valve(s) 100 are open at any given time. The efficiency at which hydrocarbon well 20 produces produced fluid stream 18 may be at least partially determined by the location, or locations, along the length of hydrocarbon well 20 at which lift gas stream 72 is injected into production conduit 60. As such, the efficiency of hydrocarbon well 20 may be evaluated and/or optimized by detecting the location, or locations, along the length of wellbore 30 at which lift gas stream 72 is injected into production conduit 60 and/or detecting which gas lift valve(s) are open at any given time. The location, or locations, along the length of wellbore 30 at which lift gas stream 72 is injected into production conduit 60 additionally or alternatively may be referred to herein as the injection location or injection locations.

The efficiency at which hydrocarbon well 20 produces produced fluid stream 18 also may be at least partially determined by the flow efficiency at which lift gas stream 72 is provided to production conduit 60 via gas lift valve(s) 100. For example, lower flow efficiencies may be caused by one or more incidental communication points 32 in the tubular 40 and/or the wellbore 30 that permit lift gas 74 to exit lift gas supply conduit 65 outside of gas lift valve(s) 100. An example of an incidental communication point 32 includes a hole that extends through tubular 40 and permits lift gas 74 to enter production conduit 60 in an uncontrolled manner. Such an incidental communication point 32 may be referred to as an uncontrolled injection point 34. Another example of an incidental communication point 32 may include a hole in wellbore 30 that permits lift gas, of the lift gas stream, to exit hydrocarbon well 20 and/or exit the lift gas supply conduit 65 without being provided to the production conduit.

As shown in FIG. 1, hydrocarbon wells 20 according to the present disclosure further include a radioactive tracer system 80 configured to indicate a flow path of lift gas within hydrocarbon well 20. Radioactive tracer system 80 includes a radioactive tracer injection unit 82, which is in fluid communication with lift gas supply conduit 65 and configured to inject a radioactive tracer 86 into lift gas stream 72 to produce a tracer-marked gas band 90 within lift gas stream 72. Tracer-marked gas band 90 additionally or alternatively may be referred to as tracer-labelled gas band 90, radioactive tracer-marked gas band 90, and/or tracer-marked portion of lift gas stream 72. Within tracer-marked gas band 90, lift gas stream 72 includes a mixture of lift gas 74 and radioactive tracer 86. That said, radioactive tracer 86 may form a minority component of the mixture. For example, upon injection of the radioactive tracer into the lift gas stream, the radioactive tracer may form, on a percent molar basis, less than 1% of the mixture, less than 0.5%, less than 0.1%, less than, 0.01%, less than 0.001%, more than 0.01%, and/or more than 0.001% of the mixture.

Radioactive tracer system 80 further includes a radiation detector 84 that is configured to detect radioactive tracer 86 within produced fluid stream 18. Radiation detector 84 may be directly coupled to, indirectly coupled to, disposed adjacent to, and/or otherwise associated with, production conduit 60 and/or any suitable fluid conduit and/or tubular that may receive at least a subset of produced fluid stream 18 from hydrocarbon wells 20 and/or from production conduit 60. As specific examples, radiation detector 84 may be configured to detect radioactive tracer 86 within a wellhead of the hydrocarbon well, within a test separator of the hydrocarbon well, and/or within a flow line connected to the wellhead of the hydrocarbon well.

Radiation detector 84 also may be positioned within, or adjacent to, surface region 10.

During operation of hydrocarbon wells 20, tracer-marked gas band 90 may flow through lift gas supply conduit 65 along with lift gas stream 72. In particular, tracer-marked gas band 90 may flow at a similar, at least substantially similar, or the same linear flow rate as lift gas stream 72. Upon reaching an open gas lift valve 102, at least a portion of tracer-marked gas band 90 may flow into production conduit 60, via open gas lift valve 102, and mix with reservoir liquid 16 therein to produce a tracer-marked liquid band 92 within produced fluid stream 18. Tracer-marked liquid band 92 may include a mixture of reservoir liquid 16, lift gas 74, and radioactive tracer 86. As such, tracer-marked liquid band 92 additionally or alternatively may be referred to herein as tracer-marked fluid band 92. Tracer-marked liquid band 92 then may travel with produced fluid stream 18 from subsurface region 12 to surface region 10.

Additionally or alternatively, at least a portion of tracer-marked gas band 90 may flow into production conduit 60 via one or more uncontrolled injection points 34 as discussed herein and mix with reservoir liquid 16 therein to produce a corresponding tracer-marked liquid band 92 within produced fluid stream 18.

Tracer-marked liquid band 92 may travel at a similar, at least substantially similar, or the same linear flow rate as produced fluid stream 18. As referred to herein, the linear flow rate of lift gas stream 72 may be the flow rate of the lift gas stream along, or parallel to, the length of the hydrocarbon well. The linear flow rate of produced fluid stream 18 may be the flow rate of produced fluid stream 18 along, or parallel to, the length of the hydrocarbon well, and may be generally in the opposite direction of lift gas stream 72, at least within a given region of wellbore 30.

Radiation detector 84 may be configured to detect radioactive tracer 86 within tracer-marked liquid band 92 as tracer-marked liquid band 92 flows past radiation detector 84. As discussed in more detail herein, the position along the length of wellbore 30 through which radioactive tracer 86 enters production conduit 60 may be determined and/or estimated based, at least in part, upon the duration of time between injection of radioactive tracer 86 into lift gas stream 72 and detection of radioactive tracer 86 in produced fluid stream 18. With this in mind, radioactive tracer system 80 may be configured to, or may be configured to be utilized to, identify which gas lift valve(s) 100 of hydrocarbon well 20 are open at any given time and/or during any given time interval. Additionally or alternatively, radioactive tracer system 80 may be configured to, or may be configured to be utilized to, identify the presence of incidental communication point(s) 32 in hydrocarbon well 20 and/or identify the location of the incidental communication point(s) 32 along the length of wellbore 30.

For examples in which hydrocarbon well 20 includes a plurality of open gas lift valves 102, a respective portion of tracer-marked gas band 90 may flow through each open gas lift valve 102 into production conduit 60 to produce a respective plurality of tracer-marked liquid bands 92 within produced fluid stream 18. In other words, radioactive tracer 86 may be injected as a plurality of portions into production conduit 60, with each portion being injected at a different location along the length of hydrocarbon well 20 and/or through a different open gas lift valve 102. The location at which each portion of radioactive tracer 86 enters production conduit 60, or the open gas lift valve 102 through which each portion enters production conduit 60, may be determined and/or estimated based, at least in part, upon the duration of time between injection of radioactive tracer 86 into lift gas stream 72 and detection of each portion of radioactive tracer 86 in produced fluid stream 18 and/or the detection of each tracer-marked liquid band 92. More specific examples of determining the injection location of radioactive tracer 86, and/or portions thereof, are discussed in more detail herein with reference to FIG. 2 and methods 500.

Additionally or alternatively, a similar situation may arise when hydrocarbon well 20 includes a single open gas lift valve 102, or even when each gas lift valve is closed, and at least a portion of lift gas stream 72 is provided to production conduit 60 via one or more uncontrolled injection points 34. The location of the one or more uncontrolled injection points 34 and/or the single open gas lift valve may be determined and/or estimated based, at least in part, upon the duration of time between injection of radioactive tracer 86 into lift gas stream 72 and detection of each portion of radioactive tracer 86 in produced fluid stream 18 and/or the detection of each tracer-marked liquid band 92.

Radioactive tracer 86 may naturally or automatically (i.e., without external stimulus) emit radiation through radioactive decay. For example, radioactive tracer 86 may include at least chemical species (e.g., a molecule or a monoatomic species) having at least one isotope that undergoes radioactive decay. Radioactive tracer 86 may be selected to emit any suitable type of radiation. For example, radioactive tracer 86 may be selected to emit radiation within an energy range that can be detected by radiation detector 84. As more specific examples, radioactive tracer 86 may include at least one gamma emitter, which may be defined herein as a chemical species that emits gamma radiation upon radioactive decay. Additionally or alternatively, radioactive tracer 86 may include at least one beta emitter, which may be defined herein as a chemical species that emits beta radiation upon radioactive decay. Both beta emitters and gamma emitters also may emit X-ray radiation upon radioactive decay.

Examples of suitable gamma emitters include Xenon-133 gas, Iodine-131, and/or molecular compounds including Iodine-131, such as iodomethane. Examples of suitable beta emitters include Krypton-85 gas, tritiated molecules, and/or one or more tritiated gasses. As used herein, a tritiated molecule includes any hydrogen-containing molecule in which at least one of the hydrogen substituents is the tritium isotope thereof. A tritiated gas may be a tritiated molecule that is gaseous at standard temperature and pressure. More specific examples of tritiated molecules include tritiated dihydrogen, tritiated water, and/or tritiated hydrocarbons such as tritiated methane.

Radioactive tracer 86 may be selected to be gaseous at standard temperature and pressure, such that radioactive tracer 86 may easily diffuse into, and travel with, lift gas stream 72. As discussed in more detail herein, one or more naturally occurring radioactive materials (NORMS) that emit radiation via radioactive decay may be present in reservoir liquid 16. In some examples, radioactive tracer 86 is selected to be different from the one or more NORMS that may be present in the reservoir liquid 16. Additionally or alternatively, NORMS present in reservoir liquid 16 may produce a background radiation in the produced fluid stream, and radioactive tracer 86 may be selected to emit radiation at one or more radiation energies that are absent from, or of a reduced intensity in, the background radiation of the produced fluid stream.

In some examples, radioactive tracer 86 includes a mixture of, or a plurality of, different radioactive tracer gasses, with each radioactive tracer gas being selected to possess a unique diffusion coefficient and/or a unique radiation spectrum. In such examples, the mixture of radioactive tracer gasses may produce a selected emission spectrum that is easily distinguished from the background radiation. Additionally or alternatively, utilizing the mixture of radioactive tracer gasses with different diffusion coefficients may allow for any band broadening or longitudinal diffusion effect of the radioactive tracer within the lift gas stream to be better identified and accounted for, which may improve the accuracy with which the injection location(s) is determined.

In some examples, radioactive tracer 86 is selected to emit a radiation that penetrates at least a region of tubular 40, such as a region of tubular 40 that extends and/or is positioned within surface region 10. As an example, X-ray radiation and gamma radiation may penetrate through a wall of tubular 40 and thus may be detected from exterior to production conduit 60. With this in mind, in some examples, utilizing at least one gamma emitter in, or as, radioactive tracer 86 may be beneficial, as the at least one gamma emitter may be detected within production fluid stream 18 by a radiation detector 84 that is completely exterior to production conduit 60, that is mounted on an external surface of tubular 40, and/or that does not need any detection structure (e.g., a probe) extending into production conduit 60 to detect radioactive tracer 86 therein.

Radiation detector 84 may be configured to detect any suitable type of radiation from radioactive tracer 86 and/or may be configured to detect radiation from radioactive tracer 86 in any suitable manner. As examples, radiation detector 84 may be configured to detect one or more of gamma radiation, beta radiation, X-ray radiation, and/or ions produced by one or more of gamma radiation, beta radiation, and X-ray radiation. As more examples, radiation detector 84 may include any suitable type of radiation detector such as one or more of a scintillation counter, a Geiger counter, an ionization chamber, a gamma ray spectrometer, an X-ray detector, and/or an X-ray spectrometer.

Radiation detector 84 also may be configured to detect radiation across a spectrum of radiation energies. Radiation detector 84 also may be configured to measure an intensity of radiation emitted by the production fluid stream at a plurality of different radiation energies within the spectrum of radiation energies. As examples, the spectrum of radiation energies may be in the range of at least 1 kiloelectron volt (KeV), at least 2 KeV, at least 5 KeV, at least 20 KeV, at least 50 KeV, at least 100 KeV, at least 200 KeV, at least 500 KeV, at least 1 megaelectron volt (MeV), at least 2 MeV, at least 3 MeV, at least 4 MeV, at least 5 MeV, at least 6 MeV, at least 7 MeV, at least 8 MeV, at most 100 KeV, at most 200 KeV, at most 500 KeV, at most 1 MeV, at most 2 MeV, at most 3 MeV, at most 4 MeV, at most 5 MeV, at most 6 MeV, at most 7 MeV, at most 8 MeV, and/or at most 10 MeV.

Radiation detector 84 may be configured to detect radioactive tracer 86 in situ within produced fluid stream 18 and/or in situ within production conduit 60. As referred to herein, radiation detector 84 being configured to detect the radioactive tracer "in situ" within production conduit 60 and/or within produced fluid stream 18 may refer to radiation detector 84 detecting radioactive tracer 86 without diverting, aliquoting, drawing, sampling, and/or otherwise removing the produced fluid stream from production conduit 60. As discussed, conventional lift gas tracing systems, such as $CO_2$ injection, typically require pressure containment of the produced fluid stream to be broken for direct sampling of the produced fluid stream. Thus, unlike conventional lift gas tracing systems, radioactive tracer system 80, according to the present disclosure, may be configured to indicate the flow path of lift gas within the hydrocarbon well in a non-invasive manner that does not incur the risk of breaking containment pressure. Additionally or alternatively, radioactive tracer system 80 may be implemented and/or installed in existing hydrocarbon wells with minimal modification thereto, as radioactive tracer systems 80 may not require a sampling line to be installed into the production conduit and/or a slip stream to be withdrawn from the production conduit.

As more specific examples, radiation detector 84 may be disposed exterior to production conduit 60, attached to an exterior of tubular 40, and/or positioned adjacent to exterior of tubular 40. In other words, radiation detector 84 may be configured to detect radiation from produced fluid stream 18 through the wall of tubular 40. In some examples, radiation detector 84 includes a radiation-detecting probe 88 that extends within production conduit 60 and is configured to detect ions that are generated by radiation from radioactive tracer 86. In particular, radiation-detecting probe 88 may be included in radiation detector 84 and/or may be utilized in examples in which radioactive tracer 86 emits radiation that is not sufficiently penetrating to be detected from exterior to, production conduit 60 and/or through the wall of tubular 40. An example of such a radioactive tracer 86 may include a beta emitter. Such a radioactive tracer 86 may emit ionizing radiation that causes ions to be formed within produced fluid stream 18, and radiation detector 84 may be configured to detect these ions, such as in the form of an electrical current. In some examples, radiation-detecting probe 88 is fluidly sealed within production conduit 60, while being electrically connected to a region exterior to production conduit 60, such that radiation-detecting probe 88 may be utilized to detect radiation within production conduit 60 without breaking the pressure containment of production conduit 60.

Radiation detector 84 may be described as being configured to detect radioactive tracer 86 within produced fluid stream 18 by gathering radiation from the produced fluid stream. More specifically, radiation detector 84 may be configured to gather a background radiation from produced fluid stream 18, which may include radiation that is naturally emitted by produced fluid stream 18. In other words, the background radiation may be the intensity and/or spectrum of radiation emitted by produced fluid stream 18 outside of tracer-marked liquid band 92 and/or in the absence of radioactive tracer 86. For example, the background radiation may include naturally occurring radiation emitted by NORMS present in the produced fluid stream. Radiation detector 84 may be configured to detect radioactive tracer 86 within produced fluid stream 18 based upon a threshold deviation from the background radiation in the radiation gathered from the produced fluid stream. Radiation detector 84 additionally or alternatively may be configured to indicate when the radiation emitted by the produced fluid stream exceeds the background radiation to indicate detection of the radioactive tracer 86.

As more specific examples, the threshold deviation may include a threshold increase in a detected intensity of one or more diagnostic radiation energies in the radiation from the produced fluid stream from a background intensity of the one or more diagnostic radiation energies in the background radiation. In some such examples, radiation detector 84 includes a spectrometer configured to detect the intensities of specific radiation energies, such as the diagnostic radiation energy(ies), within a spectrum of radiation energies. The one or more diagnostic radiation energies may be selected to correspond to intensity maxima in the emission spectrum of selected radioactive tracer 86. In this way, the diagnostic radiation energies may be distinguished from the background radiation. More specific examples of the threshold increase include at least 5%, at least 10%, at least 20%, at least 30%, at least 40%, at least 50%, at least 100%, at least 200%, at most 50%, at most 75%, at most 100%, and/or at most 200% of the background intensity of the one or more diagnostic radiation energies.

Additionally or alternatively, in some examples, radiation detector 84 may be configured to detect a total, or integrated, radiation intensity emitted by produced fluid stream 18 across a spectrum of radiation energies. In such examples, the threshold deviation may include a threshold increase in the total radiation intensity from a total background radiation intensity of the background radiation across the spectrum of radiation energies. In some such examples, radiation detector 84 may include a broadband radiation detector, such as a Geiger counter or an ionization chamber, and/or may not require a spectrometer. More specific examples of this threshold increase include at least 5%, at least 10%, at least 20%, at least 30%, at least 40%, at least 50%, at least 100%, at least 200%, at most 50%, at most 75%, at most 100%, and/or at most 200% of the total background radiation intensity across the spectrum of radiation energies.

As yet another example, radiation detector 84 may be configured to detect radioactive tracer 86 within produced fluid stream by detecting an electrical current within the produced fluid stream. More specifically, radiation detector 84 may be configured to detect a background electrical current in the produced fluid stream that is present in the produced fluid stream absent the radioactive tracer and/or that is naturally occurring in the produced fluid stream. Radiation detector 84 may be configured to detect, or indicate the presence of, the radioactive tracer within the produced fluid stream when the electrical current detected in the produced fluid stream exceeds the background electrical current by a threshold electrical current increase. In particular, an increase in the electrical current within the produced fluid stream generated by the radioactive tracer may result from ionizing radiation emitted by the radioactive tracer, as discussed herein. More specific examples of the threshold electrical current increase include at least 5%, at least 10%, at least 20%, at least 30%, at least 40%, at least 50%, at least 100%, at least 200%, at most 50%, at most 75%, at most 100%, and/or at most 200% of the magnitude of the background electrical current.

With continued reference to FIG. 1, radioactive tracer injection unit 82 may include any suitable structure and/or mechanism configured to inject radioactive tracer 86 into lift gas stream 72. Radioactive tracer injection unit 82 is in fluid communication with, or selective fluid communication with, lift gas supply conduit 65. Radioactive tracer injection unit 82 may include a port or inlet configured to provide selective access to lift gas supply conduit 65 through which radioactive tracer 86 may be injected. Radioactive tracer injection unit 82 may be configured to permit manual injection of radioactive tracer 86 into lift gas supply conduit 65. Additionally or alternatively, radioactive tracer injection unit 82 may include an automated or mechanized system configured to selectively inject a selected amount, or volume, of radioactive tracer into lift gas supply conduit 65.

Radioactive tracer injection unit 82 may be configured to inject the selected amount of radioactive tracer per injection or for each instance of injection of the radioactive tracer. In some examples, the selected amount of radioactive tracer 86 is based upon, or proportional to, a production rate of hydrocarbon well 20. As examples, the selected amount of the radioactive tracer may be at least 1 millicurie (mCi), at least 1.5 mCi, at least 1.8 mCi, at least 2 mCi, at least 2.5 mCi, at most 1.8 mCi, at most 2.5 mCi, at most 3 mCi, at most 4 mCi, and/or at most 5 mCi per 1000 barrels of fluid produced per day by the hydrocarbon well.

Radioactive tracer injection unit 82 also may be configured to inject radioactive tracer 86 into lift gas stream 72 in a modulated injection profile. The modulated injection profile may include any suitable injection pattern, such as a plurality of injection pulses that are injected in a predetermined temporal pattern. In other words, the selected amount of radioactive tracer 86 may be injected in the plurality of injection pulses. The modulated injection profile may be configured to produce a modulated radiation signal for detection by the radiation detector. The modulated radiation signal may enhance distinction of radiation emitted by radioactive tracer 86 from the background radiation. More specifically, when injected in lift gas stream 72, the modulated injection profile may generate a plurality of tracer-marked gas sub-bands within tracer-marked gas band 90. The plurality of tracer-marked gas sub-bands may produce a corresponding plurality of tracer-marked liquid sub-bands within tracer-marked liquid band 92 when the tracer-marked gas band 90 flows into production conduit 60 to produce tracer-marked liquid band 92. In this way, the tracer-marked liquid sub-bands may flow past radiation detector 84 in a uniformly spaced-apart manner corresponding to the modulated injection profile and thereby may produce the modulated radiation signal.

Radioactive tracer injection unit 82 may include a supply of radioactive tracer 86. As examples, the supply of radioactive tracer 86 may include at least 1 milliliter (mL), at most 2 mL, at most 5 mL, at most 10 mL, at most 20 mL, at most 50 mL, at most 100 mL, at most 500 mL, at most 1 liter (L), and/or at most 2 L of the radioactive tracer. In some examples, radioactive tracer injection unit 82 is configured to selectively draw radioactive tracer 86 from the supply of radioactive tracer 86 to selectively inject the radioactive tracer into lift gas stream 72. As such, radioactive tracer systems may utilize a considerably smaller volume of tracer gas than conventional lift gas tracer systems, such as $CO_2$ injection, and therefore may need less bulky equipment than conventional lift gas tracer systems.

FIG. 2 is a flowchart depicting examples of methods 500 of indicating a flow path of lift gas within a hydrocarbon well, according to the present disclosure. The hydrocarbon well may include and/or be hydrocarbon wells 20 of FIG. 1. The hydrocarbon well also may include a radioactive tracer system, such as radioactive tracer system 80 of FIG. 1, and/or radioactive tracer injection unit 82 and radiation detector 84 thereof.

Methods 500 include producing produced fluids from the hydrocarbon well at 510, injecting a radioactive tracer into the lift gas stream at 525, flowing a tracer-marked gas band into a subterranean formation at 530, flowing the tracer-marked gas band through gas lift valve(s) into a production conduit at 535, and detecting radiation from a tracer-marked liquid band at 545. Methods 500 may include providing a lift gas stream at 505, gathering background radiation at 515, selecting a radioactive tracer at 520, producing a tracer-marked liquid band from the hydrocarbon well at 540, and/or indicating a flow path of lift gas within the hydrocarbon well at 550.

Providing the lift gas stream at 505 includes providing the lift gas stream to a lift gas supply conduit of the hydrocarbon well and flowing the lift gas stream into a subterranean formation via the lift gas supply conduit. The lift gas stream may be provided in any suitable manner. As an example, the lift gas stream may be provided with, via, and/or utilizing a lift gas supply system, such as lift gas supply system 70 of FIG. 1. Examples of the lift gas stream are disclosed herein with reference to lift gas stream 72 of FIG. 1.

As discussed herein, the hydrocarbon well includes at least one gas lift valve operatively attached to a tubular of the hydrocarbon well within the subsurface region. The hydrocarbon well may include a plurality of gas lift valves operatively attached to a tubular of the hydrocarbon well and spaced apart along a length of the tubular. Each gas lift valve is configured to open to permit lift gas to flow into a production conduit of the hydrocarbon well from the lift gas supply conduit. With this in mind, the providing at 505 also may include flowing the lift gas stream from the lift gas supply conduit to the at least one open gas lift valve. In some examples, the providing at 505 includes flowing the lift gas stream through the lift gas supply conduit to each of a plurality of open gas lift valves. As also discussed herein, in some examples, the hydrocarbon well includes one or more uncontrolled injection points that permit lift gas to flow into the production conduit outside of the one or more gas lift valves. In such examples, the providing at 505 may include flowing lift gas to the one or more uncontrolled injection points. Examples of the lift gas supply conduit are disclosed herein with reference to lift gas supply conduit 65 in FIG. 1. Examples of the production conduit are disclosed herein with reference to production conduit 60 in FIG. 1. Examples of gas lift valves are disclosed herein with reference to gas lift valves 100 in FIG. 1.

The providing at 505 also may include flowing lift gas, of the lift gas stream, from the lift gas supply conduit into the production conduit through the at least one open gas lift valve. In some examples, the providing at 505 includes flowing lift gas, of the lift gas stream, from the lift gas supply conduit into the production conduit through the plurality of open gas lift valves. The providing at 505 additionally or alternatively may include flowing lift gas, of the lift gas stream, from the lift gas supply conduit into the production conduit through the one or more uncontrolled injection points. The providing at 505 further may include mixing lift gas, of the lift gas stream, with a reservoir liquid within the production conduit to generate the produced fluid stream. More specifically, the mixing may include mixing the reservoir liquid with the portion of the lift gas stream that enters the production conduit through the one or more open gas lift valves. Additionally or alternatively, the mixing may include mixing the portion of the lift gas stream that enters the production conduit through the one or more uncontrolled injection points. Thus, the providing at 505 may include generating the produced fluid stream within the production conduit at, or adjacent to, each open gas lift valve, and/or at, or adjacent to, each uncontrolled injection point.

The providing at 505 may be performed with any suitable sequence or timing within methods 500, such as prior to or at least substantially simultaneously with producing at 510 and/or prior to injecting at 525.

Methods 500 further include producing a produced fluid stream from the hydrocarbon well at 510. The producing the produced fluid stream at 510 may include flowing the produced fluid stream, within the production conduit, from the subterranean formation to a surface region of the hydrocarbon well. Examples of the produced fluid stream are disclosed herein with reference to produced fluid stream 18 in FIG. 1. The producing at 510 may be performed with any suitable sequence or timing within methods 500, such as prior to, or at least substantially simultaneously with, gathering at 515, injecting at 525, flowing at 535, and/or detecting at 545.

Methods 500 may include gathering a background radiation from the produced fluid stream at 515. The gathering at 515 may include gathering the background radiation with a radiation detector, such as radiation detector 84 of FIG. 1. As discussed herein, the radiation detector may be positioned at the surface region, or a surface-adjacent region, of the hydrocarbon well and may be configured to detect radiation from the produced fluid stream within the surface region or the surface-adjacent region of the production conduit. With this in mind, the gathering at 515 may include gathering the background radiation from the produced fluid stream at the surface region, or the surface-adjacent region, of the hydrocarbon well.

As also discussed herein, the radiation detector may be configured to gather radiation from the produced fluid stream from exterior to the production conduit. With this in mind, the gathering at 515 may include gathering the background radiation from exterior to the production conduit and/or through a wall of a tubular of the hydrocarbon well. The gathering at 515 additionally or alternatively may include gathering the radiation with a radiation-detecting probe of the radiation detector, such as radiation-detecting probe 88 of FIG. 1.

The gathering at 515 may be performed in any suitable manner. As examples, the gathering at 515 may include gathering and/or scanning for the background radiation, such as one or more of background gamma radiation, background beta radiation, and/or background X-ray radiation. Additionally or alternatively, the gathering at 515 may include detecting and/or scanning for ions produced by background ionizing radiation within the produced fluid stream, which may include gathering or detecting a background electrical current within the produced fluid stream.

The gathering at 515 may include scanning for radiation over a spectrum of radiation energies. The gathering at 515 also may include determining a total background radiation intensity of the background radiation across the spectrum of radiation energies. Additionally or alternatively, the gathering at 515 may include determining a background radiation intensity of one or more diagnostic radiation energies in the background radiation. As yet another example, the gathering at 515 may include detecting a background electrical current within the produced fluid stream, which may be performed with and/or utilizing the radiation detecting probe, such as discussed herein.

As referred to herein, the background radiation gathered from produced fluid stream 18 may be radiation that is naturally occurring within the produced fluid stream. The background electrical current also may be from radiation that is naturally occurring within the produced fluid stream. As an example, the background radiation and/or the background electrical current may be from, or generated by, NORMS that may be present within the reservoir liquid, such as discussed herein.

Put in slightly different terms, and as discussed herein, the background radiation and/or background electrical current may be the radiation and/or electrical current gathered from the produced fluid stream outside of the tracer-marked liquid band and/or in the absence of the radioactive tracer. In some examples, the level, amount, and/or type of background radiation emitted from produced fluid stream 18 may be negligible, non-present, and/or below a detection limit of the radiation detector. As such, in some examples, the gathering at 515 includes detecting no background radiation and/or an absence of background radiation.

When included, the gathering at 515 may be performed with any suitable sequence or timing within methods 500, such as prior to selecting at 520, prior to detecting at 545, and/or subsequent to detecting at 545.

With continued reference to FIG. 2, methods 500 further may include selecting a radioactive tracer at 520. The selecting at 520 may be based upon any suitable criteria. As examples, the selecting at 520 may include selecting a radioactive tracer that emits radiation that may be detected from exterior to the production conduit through the wall of the tubular. Examples of such radioactive tracers are discussed herein with reference to radioactive tracer 86 in FIG. 1. Additionally or alternatively, the selecting at 520 may be based at least in part upon the gathering at 515. For example, the selecting at 520 may include selecting a radioactive tracer that emits radiation at one or more diagnostic energies that are absent from, or of a reduced intensity in, the background radiation.

The selecting at 520 further may include selecting a volume or amount of radioactive tracer to be injected during injecting at 525. For example, the selecting at 520 may include selecting a volume or amount of the radioactive tracer that is based upon, or proportional to, a production rate of the hydrocarbon well. Examples of the amount or volume of radioactive tracer that may be selected on this basis are disclosed herein with reference to radioactive tracer injection unit 82 of FIG. 1.

When included, the selecting at 520 may be performed with any suitable sequence or timing within methods 500, such as subsequent to the gathering at 515 and/or prior to injecting at 525.

Methods 500 include injecting the radioactive tracer into the lift gas stream to generate a tracer-marked gas band within the lift gas stream at 525. The tracer-marked gas band may be described as a portion of the lift gas stream that includes a mixture of lift gas and the radioactive tracer. Examples of suitable radioactive tracers are disclosed herein with reference to radioactive tracer 86 of FIG. 1. For examples in which methods 500 include the selecting at 520, the injecting at 525 may include injecting the radioactive tracer selected at 520 and/or may include injecting the volume or amount of radioactive tracer selected at 520.

The injecting at 525 may be performed in any suitable manner. The injecting may include injecting the radioactive tracer into the lift gas supply conduit. The injecting at 525 also may include injecting the radioactive tracer with a radioactive tracer injection unit, such as radioactive tracer injection unit 82 of FIG. 1. The injecting at 525 further may include injecting the radioactive tracer into the lift gas stream at the surface region, or surface-adjacent region, of the lift gas supply conduit. In some examples, the injecting at 525 includes injecting the radioactive tracer in a plurality of injection pulses to generate a plurality of tracer-marked gas sub-bands within the tracer-marked gas band, such as discussed herein.

The injecting at 525 may be performed with any suitable sequence or timing within methods 500, such as at least substantially simultaneously with the providing at 505, subsequent to the selecting at 520, and/or prior to flowing at 535.

Methods 500 further include flowing the tracer-marked gas band into the subterranean formation at 530. The flowing at 530 includes flowing the tracer-marked gas band via the lift gas supply conduit and may include flowing the tracer-marked gas band with the lift gas stream within the lift gas supply conduit. The flowing at 530 also may include flowing the tracer-marked gas band at a similar, at least substantially similar, or the same linear flow rate as the lift gas stream.

The hydrocarbon well may include at least one open gas lift valve and/or a plurality of open gas lift valves. That said, fewer than all gas lift valves included in the hydrocarbon well may be open gas lift valves, at least at a given point in time and/or for a given radioactive trace injection. As such, the flowing at 530 further may include flowing the tracer-marked gas band to at least one open gas lift valve of the hydrocarbon well. For examples in which the hydrocarbon well includes a plurality of open gas lift valves, the flowing at 530 may include flowing a respective portion of the tracer-marked gas band to each open gas lift valve of the plurality of open gas lift valves. Additionally or alternatively, the flowing at 530 may include flowing a respective portion of the tracer-marked liquid band to each uncontrolled injection point discussed herein. Stated another way, the flowing at 530 may include flowing each respective portion of the tracer-marked gas band to a different location along the length of the hydrocarbon well.

The flowing at 530 may be performed with any suitable sequence or timing within methods 500, such as subsequent to the injecting and/or prior to flowing at 535.

With continued reference to FIG. 2, methods 500 further include flowing at least a portion of the tracer-marked gas band through an open gas lift valve and into the production conduit of the hydrocarbon well at 535. The flowing at 535 further includes mixing at least the portion of the tracer-marked gas band with the reservoir liquid, within the production conduit, to generate a tracer-marked liquid band within the produced fluid stream. With this in mind, the tracer-marked liquid band may include a mixture of the radioactive tracer, the reservoir liquid, and the lift gas. Additionally or alternatively, the flowing at 535 may include flowing at least a portion of the tracer-marked gas band through an uncontrolled injection point and into the production conduit, and mixing at least the portion of the tracer-marked liquid band with the reservoir liquid therein to generate a corresponding tracer-marked liquid band within the produced fluid stream.

The flowing at 535 may include flowing at least the portion of the tracer-marked gas band into the production conduit at the location of the open gas lift valve and/or at the location of the uncontrolled injection point along the length of the hydrocarbon well. For examples in which the hydrocarbon well includes a plurality of open gas lift valves, the flowing at 535 may include flowing a respective portion of the tracer-marked gas band through each open gas lift valve, and mixing each respective portion of the tracer-marked gas band with the reservoir liquid, within the production conduit, to produce a plurality of tracer-marked liquid bands within the produced fluid stream. The flowing at 535 also may include producing a plurality of tracer-marked liquid bands within the produced fluid stream in a similar manner for examples in which the hydrocarbon well includes a plurality of uncontrolled injection points and no open gas lift valves or for examples in which the hydrocarbon well includes a single open gas lift valve and one or more uncontrolled injection points.

In any such examples, each tracer-marked liquid band includes a respective portion of the radioactive tracer. Also in such examples, the flowing at 535 includes flowing each respective portion of the tracer-marked gas band into the production conduit at the location of the respective open gas lift valve and/or at the location of the respective uncontrolled injection point along the length of the hydrocarbon well. Thus, in such examples, the mixing comprises generating each tracer-marked liquid band at a different location along the length of the hydrocarbon well that corresponds to the location of the respective open gas lift valve or the location of the uncontrolled injection point. As mentioned, fewer than all of the gas lift valves of the hydrocarbon well may be open gas lift valves, and the flowing at 535 may include flowing the tracer-marked gas band through fewer than all of the gas lift valves of the hydrocarbon well.

For examples in which the injecting at 525 includes injecting the radioactive tracer in a plurality of injection pulses, the flowing may include flowing at least a portion of the plurality of tracer-marked gas sub-bands through the open gas lift valve or through the uncontrolled injection point and into the production conduit. Correspondingly, the mixing may include mixing at least the portion of the plurality of tracer-marked gas sub-bands to generate a plurality of tracer-marked liquid sub-bands within the tracer-marked liquid band. Similarly, for examples in which the hydrocarbon well includes a plurality of open gas lift valves, and/or one or more uncontrolled injection points, the plurality of tracer-marked liquid bands generated by the flowing at 525 each may include a respective portion of the plurality of tracer-marked gas sub-bands. In particular, each respective portion of the plurality of tracer-marked liquid sub-bands may include a respective number of the tracer-marked gas sub-bands (i.e., fewer than all tracer-marked gas sub-bands). Additionally or alternatively, each respective portion of the plurality of tracer-marked liquid sub-bands may include a respective portion (i.e., less than the entirety) of each tracer-marked gas sub-band.

Methods 500 further may include producing the tracer-marked liquid band from the hydrocarbon well at 540. When included, the producing at 540 includes flowing the tracer-marked liquid band within the production conduit. The producing at 540 may include flowing the tracer-marked liquid band from the subterranean region towards, or to, the surface region of the hydrocarbon well. The producing at 540 also may include flowing the tracer-marked liquid band to and/or past the radiation detector. The producing at 540 further may include flowing the tracer-marked liquid band with, and/or as a portion of, the produced fluid stream. Thus, the providing at 540 may include flowing the tracer-marked liquid band at a similar, at least substantially similar, or the same linear flow rate as the produced fluid stream. Stated another way, the producing at 540 may be performed along with and/or as a portion of the producing at 510. For examples in which the hydrocarbon well includes a plurality of open gas lift valves, a plurality of uncontrolled injection points, and/or one or more uncontrolled injection points and one or more open gas lift valves, the producing at 540 may include producing each of the plurality of the tracer-marked liquid bands from the hydrocarbon well at 540. The producing at 540 may be performed with any suitable sequence or timing within methods 500 such as subsequent to the flowing at 535 and/or prior to the detecting at 545.

Methods 500 include detecting radiation from the tracer-marked liquid band of the produced fluid stream at 545. The detecting radiation at 545 may be performed in any suitable manner. As examples, the detecting at 545 may be performed with the radiation detector, such as in a similar, or at least substantially similar, manner to that discussed herein for the gathering at 515.

The detecting at 545 may include detecting radiation from the radioactive tracer within the tracer-marked liquid band. The detecting at 545 also may include detecting the radioactive tracer within the tracer-marked liquid band, such as based upon the radiation detected therefrom. The detecting at 545 may include detecting any suitable type of radiation emitted by the radioactive tracer and/or detecting ions produced by radiation from the radioactive tracer. As examples, the detecting at 545 may include detecting at least one of gamma radiation emitted by the radioactive tracer, beta radiation emitted by the radioactive tracer, and X-ray radiation emitted by the radioactive tracer. The detecting at 545 also may include scanning for radiation over a spectrum of radiation energies. Examples of the spectrum of radiation energies are disclosed herein with reference to radiation detector 84 in FIG. 1. Additionally or alternatively, the detecting at 545 may include detecting an electrical current within the tracer-marked liquid band generated by ionizing radiation emitted by the radioactive tracer.

In some examples, the detecting 545 may include detecting the radioactive tracer from exterior to the production conduit and/or through the wall of the tubular. In such examples, the detecting at 545 may include detecting radiation from the tracer-marked liquid band that penetrates the tubular, the wall of the tubular, and/or the wall that surrounds the production conduit. Examples of radiation that may penetrate the tubular are disclosed herein with reference to radioactive tracer 86 and FIG. 1.

Additionally or alternatively, the detecting at 545 may include detecting the radioactive tracer from within the production conduit and/or within the tubular. In such examples, the detecting at 545 may include utilizing a radiation-detecting probe, such as radiation detecting probe 88 discussed herein, to detect radiation from the tracer-marked liquid band within the production conduit and/or within the tubular. In some such examples, the detecting includes detecting radiation from the tracer-marked liquid band that does not penetrate the tubular.

The detecting at 545 further may include distinguishing the tracer-marked liquid band within the produced fluid stream. The distinguishing may include comparing the radiation from the tracer-marked liquid band with the background radiation collected during the gathering at 515, and the detecting the radioactive tracer within the tracer-marked liquid band may be based upon the comparing. As an example, the comparing may include comparing a detected intensity of one or more diagnostic radiation energies in the radiation from the tracer-marked liquid band with the background intensity of the one or more diagnostic radiation energies in the background radiation. In such an example, the distinguishing may include determining that the detected intensity of the one or more diagnostic radiation energies exceeds the background intensity of the one or more diagnostic radiation energies in the background radiation.

As another example, the comparing may include comparing a total intensity of the radiation detected from the tracer-marked liquid band across the spectrum of radiation energies with the total background radiation intensity of the background radiation across the spectrum of radiation energies. In such an example, the distinguishing may include determining that the total intensity of the radiation detected from the tracer-marked liquid band exceeds the total background radiation intensity of the background radiation.

As yet another example, the comparing may include comparing an electrical current detected from the tracer-marked liquid band with the background electrical current gathered during the gathering at 515, and the distinguishing may include determining that a magnitude of the electrical current detected from the tracer-marked liquid band exceeds the background electrical current.

For examples in which the injecting at 525 includes generating the plurality of tracer-marked gas sub-bands within the tracer-marked gas band, the detecting may include detecting a modulated radiation signal from the plurality of tracer-marked liquid sub-bands of the produced fluid stream. In such examples, the distinguishing may include detecting the modulated radiation signal from the tracer-marked liquid band.

For examples in which the hydrocarbon well includes a plurality of open gas lift valves, a plurality of uncontrolled injection points, and/or one or more uncontrolled injection points and one or more open gas lift valves, and/or in which the flowing at 535 includes producing the plurality of tracer-marked liquid bands within the produced fluid stream, the detecting at 545 may include detecting radiation from at least some of, and optionally each, tracer-marked liquid band of the plurality of tracer-marked liquid bands in the produced fluid stream. In particular, the detecting at 545 may include detecting each tracer-marked liquid band in a similar, or at least substantially similar, manner.

The detecting at 545 may be performed with any suitable sequence or timing within methods 500. As examples, the detecting at 545 may be performed subsequent to the flowing at 535, at least substantially simultaneously with the producing at 540, and/or prior to indicating at 550.

Methods 500 also may include indicating a flow path of lift gas within the hydrocarbon well at 550. The indicating at 550 may include determining a tracer flow time of the radioactive tracer within the hydrocarbon well by determining a time duration between the injecting at 525 and the detecting the tracer-marked liquid band at 545. The indicating at 550 further may include identifying, based upon the tracer flow time, the open gas lift valve through which at least the portion of the tracer-marked gas band flows into the production conduit during the flowing at 535. The indicating at 550 additionally or alternatively may include identifying, based upon the tracer flow time, an uncontrolled injection point through which at least the portion of the tracer-marked gas band flows into the production conduit during the flowing at 535. The identifying also may be based upon a linear flow rate of the lift gas stream and/or a linear flow rate of the produced fluid stream. The indicating at 550 additionally or alternatively may include estimating, based upon the tracer flow time, the flow rate of the lift gas stream, and/or the flow rate of the produced fluid stream, a location along the length of the hydrocarbon well at which at least the portion of the tracer-marked liquid band flows into the production conduit during the flowing at 535, and the identifying may include identifying the open gas lift valve based upon the estimating.

In some examples, the radioactive tracer diffuses longitudinally within the lift gas stream during the flowing at 530 and/or diffuses longitudinally within the produced fluid stream during the producing at 540. In this way, the volume and/or linear extent of the tracer-marked gas band within the lift gas stream may increase during the flowing at 535. Additionally or alternatively, the volume and/or linear extent of the tracer-marked liquid band within the produced fluid stream may increase during the producing at 540. Thus, in some such examples, the tracer-marked liquid band may flow past the radiation detector over a period of time. In other words, the detecting at 545 may include detecting radiation from the tracer-marked liquid band over a period of time, such as seconds or even minutes. With this in mind, the tracer flow time may be determined as the duration between the injecting at 525 and the point at which, during the detecting at 545, the intensity of the radiation detected from the tracer-marked liquid band reaches a maximum, or a selected, threshold. Additionally or alternatively, the tracer flow time may be determined as the duration between the injecting at 525 and a median of a period of time in which the intensity of the radiation detected from the tracer-marked liquid band remains above a selected threshold.

The indicating at 550 may include identifying each open gas lift valve included in the hydrocarbon well. The indicating at 550 additionally or alternatively may include identifying each uncontrolled injection point included in the hydrocarbon well. For examples in which the hydrocarbon well includes a plurality of open gas lift valves, the indicating at 550 may include identifying the open gas lift valve or the uncontrolled injection point through which each respective portion of the tracer-marked gas band flows into the production conduit during the flowing at 535. Stated another way, the indicating at 550 may include identifying the open gas lift valve or the uncontrolled injection point corresponding to each tracer-marked liquid band detected during the detecting at 545. As an example, the indicating at 550 may include determining a plurality of tracer flow times of the radioactive tracer within the hydrocarbon well by determining a duration between the injecting the radioactive tracer at 525 and the detecting radiation from each tracer-marked liquid band during the detecting at 545. In such an example, the identifying may include identifying the open gas lift valve or the uncontrolled injection point through which each respective portion of the tracer-marked gas band flows into the production conduit based upon the plurality of tracer flow times.

Additionally or alternatively, the indicating may include estimating, based upon each tracer flow time, the flow rate of the lift gas stream, and/or the flow rate of the produced fluid stream, a respective location along the hydrocarbon well at which each respective portion of the tracer-marked gas band flows into the production conduit during the flowing at 535. In such an example, the identifying the plurality of open gas lift valves may be based on the plurality of locations estimated during the estimating.

As yet another example, the hydrocarbon well may include one or more incidental communication points that permit lift gas, from the lift gas stream, to exit the hydrocarbon well within the subterranean region, or without being provided to the production conduit. Correspondingly, the flowing at 535 may include flowing at least a portion of the tracer-marked gas band through the one or more incidental communication points such that less than all of the tracer-marked gas band is provided to the production conduit.

In some examples, the detecting at 545 may include determining a detected integrated, or total, amount of (e.g., counts of) radiation gathered from all tracer-marked liquid band(s) in the produced fluid stream. In some such examples, the indicating at 550 may include predicting a predicted integrated, or total, amount of radiation that is expected to be gathered from the radioactive tracer in the produced fluid stream, or from all tracer-marked liquid band(s) in the produced fluid stream, such as based upon the amount of radioactive tracer injected during the injecting at 525. Correspondingly, the indicating at 550 may include comparing the detected integrated amount of radiation with the predicted integrated amount of radiation and indicating that less than all of the tracer-marked gas band is being provided to the production conduit when the detected integrated amount of radiation is less than the predicted amount of radiation. Thus, the indicating at 550 may include indicating the presence of one or more incidental communication points within the hydrocarbon well when the indicating 550 includes determining that less than all of the tracer-marked gas band is being provided to the production conduit.

In some examples, methods 500 further include adjusting operation of the hydrocarbon well based upon the indicating at 550 such as to improve the efficiency of the hydrocarbon well. As an example, the adjusting may include selectively opening one or more gas lift valves that are identified as being closed during the indicating at 550 and that should be opened to enhance the efficiency of the hydrocarbon well. Additionally or alternatively, the adjusting may include selectively closing one or more gas lift valves that are identified as being open during the indicating at 550 and that should be closed to enhance the efficiency of the hydrocarbon well. As yet another example, the adjusting may include adjusting the selected pressure differential of a gas lift valve at which the gas lift valve is configured to selectively open.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, includes not only the recited "substantial" degree or relationship, but also the full extent of the recited degree or relationship. A substantial amount of a recited degree or relationship may include at least 75% of the recited degree or relationship. For example, an object that is at least substantially formed from a material includes an object for which at least 75% of the object is formed from the material and also includes an object that is completely formed from the material. As another example, a first direction that is at least substantially parallel to a second direction includes a first direction that forms an angle with respect to the second direction that is at most 22.5 degrees and also includes a first direction that is exactly parallel to the second direction. As another example, a first length that is substantially equal to a second length includes a first length that is at least 75% of the second length, a first length that is equal to the second length, and a first length that exceeds the second length such that the second length is at least 75% of the first length.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A hydrocarbon well, comprising:

a wellbore extending within a subsurface region;

a tubular extending within the wellbore, wherein the tubular defines a tubular conduit, and further wherein the wellbore and the tubular define an annular space therebetween;

a lift gas supply system configured to provide a lift gas stream that includes a lift gas to a lift gas supply conduit, wherein one of the tubular conduit and the annular space defines the lift gas supply conduit, and further wherein the other of the tubular conduit and the annular space defines a production conduit configured to produce a produced fluid stream, which includes a reservoir liquid, from the subsurface region;

one or more gas lift valves operatively attached to the tubular within the subsurface region, wherein each gas lift valve of the one or more gas lift valves is configured to selectively open to permit the lift gas to flow into the production conduit from the lift gas supply conduit and to mix with the reservoir liquid therein to generate the produced fluid stream; and a radioactive tracer system configured to indicate a flow path of the lift gas within the hydrocarbon well, wherein the radioactive tracer system includes:

a radioactive tracer injection unit in fluid communication with the lift gas supply conduit and configured to inject a radioactive tracer into the lift gas stream to produce a tracer-marked gas band within the lift gas stream; and a radiation detector configured to detect the radioactive tracer within the produced fluid stream;

wherein, upon injection of the tracer-marked gas band into the production conduit, the tracer-marked gas band is configured to mix with the reservoir liquid therein to generate a tracer-marked liquid band within the produced fluid stream, wherein radiation from the radioactive tracer generates ions within the tracer-marked liquid band, wherein the radiation detector is configured to detect the ions generated by the radiation from the radioactive tracer within the tracer-marked liquid band to detect the radioactive tracer within the produced fluid stream, and further wherein the radiation detector comprises a radiation-detecting probe extending within the production conduit and configured to detect the ions generated by the radiation from the radioactive tracer.

2. The hydrocarbon well of claim 1, wherein the radiation detector is configured to detect one or more of:

(i) gamma radiation;

(ii) beta radiation;

(iii) X-ray radiation; and (iv) ions produced by gamma radiation, X-ray radiation, or beta radiation.

3. The hydrocarbon well of claim 1, wherein the radiation detector is one or more of:

(i) disposed exterior to the production conduit;

(ii) attached to an exterior of the tubular; and (iii) positioned adjacent to the exterior of the tubular.

4. The hydrocarbon well of claim 1, wherein the radiation detector is configured to detect radiation across a spectrum of radiation energies.

5. The hydrocarbon well of claim 1, wherein the radiation detector is configured to one or more of:

(i) detect the radioactive tracer in situ within the produced fluid stream; and (ii) detect the radioactive tracer in situ within the production conduit.

6. The hydrocarbon well of claim 1, wherein the radiation detector is configured to detect the radiation from the radioactive tracer through a wall of the production conduit.

7. The hydrocarbon well of claim 1, wherein the radiation detector includes one or more of:

(i) a scintillation counter;

(ii) a Geiger counter;

(iii) an ionization chamber;

(iv) a gamma ray spectrometer; and (v) an X-ray spectrometer.

8. The hydrocarbon well of claim 1, wherein the radioactive tracer is selected to emit radiation that penetrates at least a region of the tubular.

9. The hydrocarbon well of claim 1, wherein the radioactive tracer is selected to be different from one or more naturally occurring radioactive materials (NORMS) present in the reservoir liquid.

10. The hydrocarbon well of claim 1, wherein the radioactive tracer injection unit includes a supply of the radioactive tracer, and wherein the supply includes at least 1 milliliter (mL) and at most 2 liters (L) of the radioactive tracer.

11. The hydrocarbon well of claim 1, wherein the radioactive tracer injection unit is configured to inject an amount of the radioactive tracer that is based upon a production rate of the hydrocarbon well, and wherein the amount of the radioactive tracer is at least 1 millicurie (mCi) and at most 5 mCi per 1000 barrels of fluid per day.

12. A method of tracing a flow path of lift gas within a hydrocarbon well, the method comprising:

injecting a radioactive tracer into a lift gas stream to generate a tracer-marked gas band within the lift gas stream;

flowing the tracer-marked gas band into a subterranean formation via a lift gas supply conduit of the hydrocarbon well;

flowing at least a portion of the tracer-marked gas band through an open gas lift valve of one or more gas lift valves and into a production conduit of the hydrocarbon well, wherein the flowing includes:

mixing at least the portion of the tracer-marked gas band with a reservoir liquid, within the production conduit, to generate a tracer-marked liquid band within a produced fluid stream;

producing the produced fluid stream from the hydrocarbon well via the production conduit;

detecting radiation from the tracer-marked liquid band of the produced fluid stream;

gathering a background radiation from the produced fluid stream, wherein the background radiation is gathered from the produced fluid stream outside of the tracer-marked liquid band or absent the radioactive tracer; and selecting the radioactive tracer based upon the background radiation gathered from the produced fluid stream, wherein the selecting comprises selecting the radioactive tracer to emit radiation at one or more diagnostic radiation energies that are at least one of absent from the background radiation and of a reduced intensity in the background radiation.

13. The method of claim 12, wherein the detecting comprises detecting the radiation, from the tracer-marked liquid band, that penetrates a tubular of the hydrocarbon well that at least partially defines the production conduit.

14. The method of claim 12, further comprising:

determining a tracer flow time of the radioactive tracer within the hydrocarbon well by determining a duration between the injecting the radioactive tracer and the detecting the tracer-marked liquid band; and identifying, based upon the tracer flow time, the open gas lift valve of the one or more gas lift valves through which at least the portion of the tracer-marked gas band flows into the production conduit.

15. The method of claim 14, wherein the identifying further is based upon one or more of:

(i) a flow rate of the lift gas stream; and (ii) a flow rate of the produced fluid stream.

16. A method of tracing a flow path of lift gas within a hydrocarbon well, the method comprising:

injecting a radioactive tracer into a lift gas stream to generate a tracer-marked gas band within the lift gas stream;

flowing the tracer-marked gas band into a subterranean formation via a lift gas supply conduit of the hydrocarbon well;

flowing at least a portion of the tracer-marked gas band through an open gas lift valve of one or more gas lift valves and into a production conduit of the hydrocarbon well, wherein the flowing includes:

mixing at least the portion of the tracer-marked gas band with a reservoir liquid, within the production conduit, to generate a tracer-marked liquid band within a produced fluid stream;

producing the produced fluid stream from the hydrocarbon well via the production conduit;

detecting radiation from the tracer-marked liquid band of the produced fluid stream;

wherein the injecting comprises injecting the radioactive tracer in a plurality of injection pulses to generate a plurality of tracer-marked gas sub-bands within the tracer-marked gas band, wherein the flowing comprises flowing at least a portion of the plurality of tracer-marked gas sub-bands through the open gas lift valve of the one or more gas lift valves and into the production conduit of the hydrocarbon well, mixing at least the portion of the plurality of tracer-marked gas sub-bands to generate a plurality of tracer-marked liquid sub-bands within the tracer-marked liquid band, and wherein the detecting comprises detecting a modulated radiation signal from the plurality of tracer-marked liquid sub-bands of the produced fluid stream.

17. A method of tracing a flow path of lift gas within a hydrocarbon well, the method comprising:

injecting a radioactive tracer into a lift gas stream to generate a tracer-marked gas band within the lift gas stream;

flowing the tracer-marked gas band into a subterranean formation via a lift gas supply conduit of the hydrocarbon well;

flowing at least a portion of the tracer-marked gas band through an uncontrolled injection point and into a production conduit of the hydrocarbon well, wherein the flowing includes:

mixing at least the portion of the tracer-marked gas band with a reservoir liquid, within the production conduit, to generate a tracer-marked liquid band within a produced fluid stream;

producing the produced fluid stream from the hydrocarbon well via the production conduit; and detecting radiation from the tracer-marked liquid band of the produced fluid stream;

wherein the injecting comprises injecting the radioactive tracer in a plurality of injection pulses to generate a plurality of tracer-marked gas sub-bands within the tracer-marked gas band, wherein the flowing comprises flowing at least a portion of the plurality of tracer-marked gas sub-bands through the uncontrolled injection point and into the production conduit of the hydrocarbon well, mixing at least the portion of the plurality of tracer-marked gas sub-bands to generate a plurality of tracer-marked liquid sub-bands within the tracer-marked liquid band, and wherein the detecting comprises detecting a modulated radiation signal from the plurality of tracer-marked liquid sub-bands of the produced fluid stream.

18. The method of claim 17, further comprising:

determining a tracer flow time of the radioactive tracer within the hydrocarbon well by determining a duration between the injecting the radioactive tracer and the detecting the tracer-marked liquid band; and identifying, based upon the tracer flow time, a location of the uncontrolled injection point along a length of the hydrocarbon well.

19. A method of tracing a flow path of lift gas within a hydrocarbon well, the method comprising:

injecting a tracer into a lift gas stream to generate a tracer-marked gas band within the lift gas stream;

flowing the tracer-marked gas band into a subterranean formation via a lift gas supply conduit of the hydrocarbon well;

flowing at least a portion of the tracer-marked gas band through an open gas lift valve of one or more gas lift valves and into a production conduit of the hydrocarbon well, wherein the flowing includes:

mixing at least the portion of the tracer-marked gas band with a reservoir liquid, within the production conduit, to generate a tracer-marked liquid band within a produced fluid stream;

producing the produced fluid stream from the hydrocarbon well via the production conduit;

detecting the tracer-marked liquid band of the produced fluid stream; and wherein the injecting comprises injecting the tracer in a plurality of injection pulses to generate a plurality of tracer-marked gas sub-bands within the tracer-marked gas band, wherein the flowing comprises flowing at least a portion of the plurality of tracer-marked gas sub-bands through the open gas lift valve of the one or more gas lift valves and into the production conduit of the hydrocarbon well, mixing at least the portion of the plurality of tracer-marked gas sub-bands to generate a plurality of tracer-marked liquid sub-bands within the tracer-marked liquid band, and wherein the detecting comprises detecting a signal from the plurality of tracer-marked liquid sub-bands of the produced fluid stream.

* * * * *